US011332359B2

(12) United States Patent
Hanssen et al.

(10) Patent No.: US 11,332,359 B2
(45) Date of Patent: May 17, 2022

(54) CONTAINER FOR LIQUIDS

(71) Applicant: EUROKEG B.V., Den Helder (NL)

(72) Inventors: Hubert Joseph Frans Hanssen, Badhoevedorp (NL); Jan Dirk Veenendaal, Den Helder (NL)

(73) Assignee: EUROKEG B.V., Den Helder (NL)

( * ) Notice: Subject to any disclaimer, the term of this patent is extended or adjusted under 35 U.S.C. 154(b) by 0 days.

(21) Appl. No.: 14/914,837

(22) PCT Filed: Aug. 28, 2014

(86) PCT No.: PCT/EP2014/068292
§ 371 (c)(1),
(2) Date: Feb. 26, 2016

(87) PCT Pub. No.: WO2015/028564
PCT Pub. Date: Mar. 5, 2015

(65) Prior Publication Data

US 2016/0200562 A1 Jul. 14, 2016

(30) Foreign Application Priority Data

Aug. 28, 2013 (EP) ..... 13182063

(51) Int. Cl.
*B67D 7/02* (2010.01)
*B67D 7/04* (2010.01)
(Continued)

(52) U.S. Cl.
CPC ..... *B67D 7/0266* (2013.01); *B65D 11/06* (2013.01); *B65D 11/22* (2013.01); *B65D 11/24* (2013.01);
(Continued)

(58) Field of Classification Search
CPC .... B65D 77/0486; B65D 77/06; B65D 11/24; B65D 23/0885; B65D 83/38; B29C 66/71;
(Continued)

(56) References Cited

U.S. PATENT DOCUMENTS 3,955,705 A * 5/1976 Dubois ..... B65D 11/06 206/509
4,300,612 A * 11/1981 Schroeder, Jr ..... B65D 23/0885 206/521
(Continued)

FOREIGN PATENT DOCUMENTS

AT 006 627 U2 1/2004
CN 102939250 A 2/2013
(Continued)

OTHER PUBLICATIONS

EPO Communication for European patent application 14759129.1, dated Apr. 4, 2017.
(Continued)

*Primary Examiner* — Shawn M Braden
(74) *Attorney, Agent, or Firm* — Steven M. Koehler; Westman, Champlin & Koehler, P.A.

(57) ABSTRACT

The invention relates to a container for liquids, such as beverages and oils, comprising a casing enveloped by a shell and a valve for dispensing the liquid from the container. The casing and the shell are, at least locally, positively fixed relative to each other.

22 Claims, 3 Drawing Sheets

(51) Int. Cl.

| | |
|---|---|
| ***B67D 7/84*** | (2010.01) |
| ***B67D 7/36*** | (2010.01) |
| ***B65D 6/34*** | (2006.01) |
| ***B65D 77/06*** | (2006.01) |
| ***B65D 6/38*** | (2006.01) |
| ***B65D 8/00*** | (2006.01) |

(52) U.S. Cl.
CPC ..... *B65D 77/06* (2013.01); *B67D 7/04* (2013.01); *B67D 7/36* (2013.01); *B67D 7/84* (2013.01)

(58) Field of Classification Search
CPC ..... B29C 2049/2404; B29C 49/24; B29C 66/112; B29C 66/131
USPC ..... 215/395
See application file for complete search history.

(56) References Cited

U.S. PATENT DOCUMENTS

| | | | | |
|---|---|---|---|---|
| 4,378,069 | A | 3/1983 | Franco | |
| 4,482,067 | A * | 11/1984 | Saito | B65D 23/001 206/509 |
| 4,659,425 | A | 4/1987 | Eggers et al. | |
| 4,678,101 | A | 7/1987 | Nitchman et al. | |
| 4,969,577 | A | 11/1990 | Werding | |
| 5,090,095 | A | 2/1992 | Lightfoot | |
| 5,238,150 | A | 8/1993 | Williams | |
| 5,301,838 | A | 4/1994 | Schmidt et al. | |
| 5,368,195 | A | 11/1994 | Pleet et al. | |
| 5,613,622 | A | 3/1997 | Surrena et al. | |
| 5,809,674 | A * | 9/1998 | Key | B65D 23/0885 40/306 |
| 6,375,048 | B1 | 1/2002 | van der Meer et al. | |
| 6,354,473 | B1 | 3/2002 | Brambach et al. | |
| 6,601,732 | B1 | 8/2003 | Rooney et al. | |
| 6,666,358 | B1 | 12/2003 | Field | |
| 7,597,124 | B2 | 10/2009 | Litto | |
| 7,820,257 | B2 | 10/2010 | Kjorlaug et al. | |
| 8,622,098 | B2 | 1/2014 | Veenendaal et al. | |
| 8,939,215 | B2 | 1/2015 | McMiles | |
| 9,434,505 | B2 * | 9/2016 | Apps | B65D 11/08 |
| 9,637,270 | B2 * | 5/2017 | Campbell | B65D 23/0885 |
| 2006/0237486 | A1 | 10/2006 | Kersten | |
| 2006/0257603 | A1 | 11/2006 | Shi et al. | |
| 2008/0029087 | A1 * | 2/2008 | Kidd, III | A61K 9/008 128/200.23 |
| 2008/0247684 | A1 | 10/2008 | Binks et al. | |
| 2008/0257846 | A1 | 10/2008 | Hove et al. | |
| 2008/0272145 | A1 | 11/2008 | Nimmo et al. | |
| 2009/0045222 | A1 | 2/2009 | Nimmo et al. | |
| 2009/0145924 | A1 | 6/2009 | Fiedler | |
| 2010/0077790 | A1 | 4/2010 | Apps | |
| 2010/0089488 | A1 | 4/2010 | Veenendaal et al. | |
| 2011/0108574 | A1 | 5/2011 | Nimmo et al. | |
| 2011/0290798 | A1 * | 12/2011 | Corbett | B65D 11/04 220/62.12 |
| 2012/0125943 | A1 | 5/2012 | Lee | |
| 2013/0200100 | A1 | 8/2013 | Hanssen et al. | |
| 2014/0231427 | A1 * | 8/2014 | Botet | B67D 1/0462 220/62.21 |
| 2014/0374416 | A1 * | 12/2014 | Tom | B29C 49/24 220/62.21 |
| 2015/0122811 | A1 * | 5/2015 | Tamaro | B65D 25/18 220/23.89 |
| 2015/0191297 | A1 * | 7/2015 | Hanssen | B65D 83/38 222/135 |

FOREIGN PATENT DOCUMENTS

| | | | |
|---|---|---|---|
| CN | 203048570 | U | 7/2013 |
| EP | 0389191 | A1 | 9/1990 |
| EP | 0862535 | A1 | 9/1998 |
| EP | 1736421 | A1 | 12/2006 |
| EP | 1 947 029 | A1 | 7/2008 |
| EP | 2038187 | B1 | 11/2010 |
| FR | 1412075 | A | 9/1965 |
| JP | S4919985 | A | 2/1974 |
| JP | S53-39599 | U | 4/1978 |
| JP | S5339599 | U | 4/1978 |
| JP | S62179931 | A | 8/1987 |
| JP | H07291281 | A | 11/1995 |
| JP | 1134152 | A | 2/1999 |
| JP | 2000232297 | A | 8/2000 |
| JP | 2007-181863 | A | 7/2007 |
| JP | 4150595 | B2 | 9/2008 |
| JP | 2013528537 | A | 7/2013 |
| KR | 10-2013-0076819 | A | 7/2013 |
| WO | 00/07902 | A1 | 2/2000 |
| WO | 00/78665 | A1 | 12/2000 |
| WO | 2008/000574 | A1 | 1/2008 |
| WO | 2009021976 | A1 | 2/2009 |
| WO | 2010130020 | A1 | 11/2010 |
| WO | 2011/134949 | A1 | 11/2011 |

OTHER PUBLICATIONS

International Search Report and Written Opinion for International Application No. PCT/EP2014/068292, dated Mar. 4, 2015, 14 pages.
Chinese Second Office Action for Chinese patent application No. 201480047167.1, dated Oct. 25, 2017.
Chilean Office Action for Chilean patent application No. 201600371, dated Jun. 19, 2017.
Chinese Office Action for Chinese Patent Application No. 201480047167.1, dated Oct. 25, 2017.
Japanese Office Action, dated Jun. 12, 2018 for corresponding Japanese Patent Application No. 2016-537299, filed Dec. 1, 2016.
Chilean Office Action for corresponding Chilean Application No. 201600371, filed Feb. 18, 2016.
Japanese Office Action, dated Dec. 5, 2018, for corresponding Japanese Patent Application No. 2016-537299, filed Feb. 24, 2016.
Signaporese Written Opinion for Singapore patent application No. 11201600788Q, dated Feb. 3, 2017.
Office Action from the Intellectual Property Office of the Philippines for Philippine patent application No. 1/2016/500386, dated May 9, 2019.
Office Action from the Korean Intellectual Property Office for Korean Patent Application No. 10-206-7004172, dated Jan. 15, 2020, with English translation.
Office Action from the India Patent Office for Indian patent application No. 201617008301, dated Oct. 31, 2019.
Korean Office Action for Korean patent application No. 10-2016-7004172, dated Aug. 29, 2019, with English translation.

* cited by examiner

CONTAINER FOR LIQUIDS

CROSS-REFERENCE TO RELATED APPLICATION

The present application is a national stage filing of International patent application Serial No. PCT/EP2014/068292, filed Aug. 28, 2014, and published as WO 2015/028564 A2 on Mar. 5, 2015, in English.

BACKGROUND

The discussion below is merely provided for general background information and is not intended to be used as an aid in determining the scope of the claimed subject matter.

Aspects of the invention relate to a container for liquids, such as beverages and oils, comprising a casing enveloped by a shell and a valve for dispensing the liquid from the container.

Many containers for liquids are subjected during use to high internal pressures. E.g., beverages containing a gas should be maintained at an elevated pressure, typically in a range from 1 to 4 bar (overpressure), to prevent the gas from escaping the beverage. Also, liquids having a relatively high viscosity and liquids that are dispensed from a lower level, e.g. from a cellar, require a relatively high pressure in the container to overcome friction and hydrostatic pressure, respectively. High temperatures and non-observance of safety guidelines can also lead to high internal pressures. Further, many containers for liquids are subjected during use to high external forces. E.g., containers are palletized and/or stacked.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background. A container is described that is more resistant to deformation resulting from internal pressure and/or external forces. The container includes a casing and a shell that are, at least locally, positively fixed relative to each other, preferably at least in an axial direction and/or preferably by means of an adhesive, welding or positive form locking. It is preferred that the force needed to break the fixation and/or move the casing beyond the location of the fixation is at least 100 N, preferably at least 200 N, more preferably at least 300 N, preferably at least 400 N, preferably at least 500 N, exerted on both the casing and the shell and in opposite directions coinciding with or parallel to the central axis of the container.

In an embodiment, the casing and/or the shell comprises a circumferential, not necessarily continuous, e.g. continuous or intermittent, protrusion positively locking the two in the axial direction.

Fixation as provided by the present invention prevents or reduces dislocation of the casing inside the shell, thus e.g. facilitating positioning the container on a filler head or positioning a dispense head on the valve and/or reducing the risk of the casing deforming the bottom of the container when the casing is pressurized and/or exposed to high pressures or temperatures. Uneven deformation of the bottom of the container results in wobbling of the container and impairs stacking of containers.

In an embodiment, the valve is part of or mounted on or in the casing, the shell comprises a neck fitting over the valve, and the protrusion is located at/in the neck and locks under, over or onto the valve. E.g., the valve provides an undercut and the shell an inwardly protruding rim locking in the undercut. In a refinement, the casing is snap-fitted into the shell. This facilitates assembly of the container and thus reduces costs.

In another embodiment, the fixation is located at the valve and provides a circumferential watertight seal between the valve and/or the casing on the one hand and the shell on the other hand. Thus, when liquid leaks or spills from the valve or dispense head, e.g. during coupling or decoupling, such liquid is prevented from entering the space that, in some configurations, is present between the casing and the shell.

In an embodiment, the casing has an internal volume of at least 10 liters and the length to width ratio (L/D) of the casing is in excess of 1.3, preferably in excess of 1.8 and/or the container comprises a cylindrical portion that extends over at least 25%, preferably at least 40%, more preferably at least 50% of the height of the container and/or the shell supports the casing at least when the latter is pressurized.

In an embodiment, the shell comprises an upper portion abutting the casing and a lower portion, which lower portion comprises a circumferential protrusion positively locking the casing and the shell in axial direction. In a refinement, the protrusion is defined by or comprises a local constriction and/or abuts or near abuts the bottom of the casing.

In another embodiment, the casing and/or shell comprises a further circumferential protrusion positively locking the casing in axial direction. In a refinement, the first protrusion is located above the broadest part of the casing, e.g. a cylindrical part or equator, and/or the further protrusion is located below that part.

When the further protrusion is located below that part, it may support the casing when it expands and, when or once the casing rests on the further protrusion, help resist further expansion of the casing. It is preferred that the area of contact at the protrusion has a width of at least 1 mm, preferably at least 2 mm, preferably at least 3 mm. It is further preferred that the protrusion or protrusions have a height, e.g. relative to the inner wall of the shell, of at least 1 mm, preferably at least 2 mm, preferably at least 3 mm, e.g. 4 or 5 mm.

In an embodiment, the shell comprises an upper or middle portion abutting the casing and a lower portion free from the casing and the lower portion comprises features, such as embossing, a regular pattern of inwardly and/or outwardly extending dents, or the further protrusion, locally increasing effective wall thickness and buckling resistance. Increased buckling resistance of the lower portion was found to enable stacking of more (pallets of) containers on top of each other and improves resistance to dynamic loads.

In an embodiment, which is also suitable for use in containers wherein the casing and shell are not positively fixed relative to each other, the shell comprises an upper portion abutting the casing and a lower portion free from the casing and the lower portion comprises features, such as one or more cuts, slits, or folds, the further circumferential protrusion or a plurality of further protrusions, e.g. two, three, four or five further protrusions, locally increasing flexibility of the wall, preferably at least in the axial direction of the container. Thus, when a load, e.g. another container, is placed on top of the container the shell shortens, e.g. vertically, until the casing rests on the surface or item, e.g. another container, beneath. As a result, the casing carries and/or transfers (part of) that load, the more so when it is pressurized.

In an embodiment, the features provide a bellows, e.g. formed by the mentioned plurality of further protrusions or a zigzag cross-section of the wall of the lower portion.

In the container, it is preferred that at least one of the protrusions is defined by a constriction of the wall of the shell, e.g. providing an annular protrusion on the inside of the shell and an annular notch on the outside of the shell. Such a constriction can be formed, e.g. by rotating and locally heating the shell.

In an embodiment, the container comprises a separately formed foot, optionally made of a different material, secured on or in the shell and/or to the casing en e.g. comprising all or a part of the features described above.

In an embodiment, which is also suitable for use in containers wherein the casing and shell are not positively fixed relative to each other, a lubricant, such as water, silicon, a thermoplastic e.g. PE or PTFE film or sleeve, oil, or powder, is present between the casing and the shell, preferably at the cylindrical portion (if present). It appeared that during expansion of the casing inside the shell, e.g. when the former is being filled or the pressure inside the casing increases, a stick slip phenomenon may occur which is believed to be at the root of bursting of the casing below its nominal bursting strength. The lubricant reduces or even prevents such stick slip and thus the detrimental effects resulting from stick slip.

In an embodiment, the casing and the shell are made from a blow molded, preferably a stretch blow molded thermoplastic material, preferably a polyester.

Another embodiment comprises a liquid-tight inner container, e.g. a bag, of a flexible material located inside the casing for containing the liquid and communicating with the valve.

In another embodiment, the wall thickness of both the casing and the shell is in a range from 0.1 to 1.0 mm, preferably in a range from 0.3 to 0.6 mm, providing a total wall thickness of up to 2.0 mm, and, e.g. if parts of the shell overlap each other, locally even up to 3.0 mm, which currently cannot be achieved by blowing a single preform.

In a further embodiment, the container is filled with a pressurized gas and no beverage, i.e. the container is pressurized prior to filling, e.g. with air or carbon dioxide and/or nitrogen at a pressure in excess of 1,5 bar. Thus, the container can be readily filled with a liquid containing a gas, such as beer, sparking wine, and soft drinks.

Within the framework of the present invention "stretch blow molding" refers to blow molding and thus stretching a preform, in both the circumferential (hoop) direction and the axial direction. The term "spheroid" includes any shape generated by a half-revolution of a circle or a square or rectangle with rounded corners or an ellipse or oval about its major axis or minor axis.

BRIEF DESCRIPTION OF THE DRAWINGS

Aspects of the invention will now be explained in more detail with reference to the drawings, which show a preferred embodiment of the present invention.

DETAILED DESCRIPTION OF THE ILLUSTRATIVE EMBODIMENTS

The drawings are not necessarily to scale and details, which are not necessary for understanding the present invention, may have been omitted. Further, elements that are at least substantially identical or that preform an at least substantially identical function are denoted by the same numeral.

Figure 1:
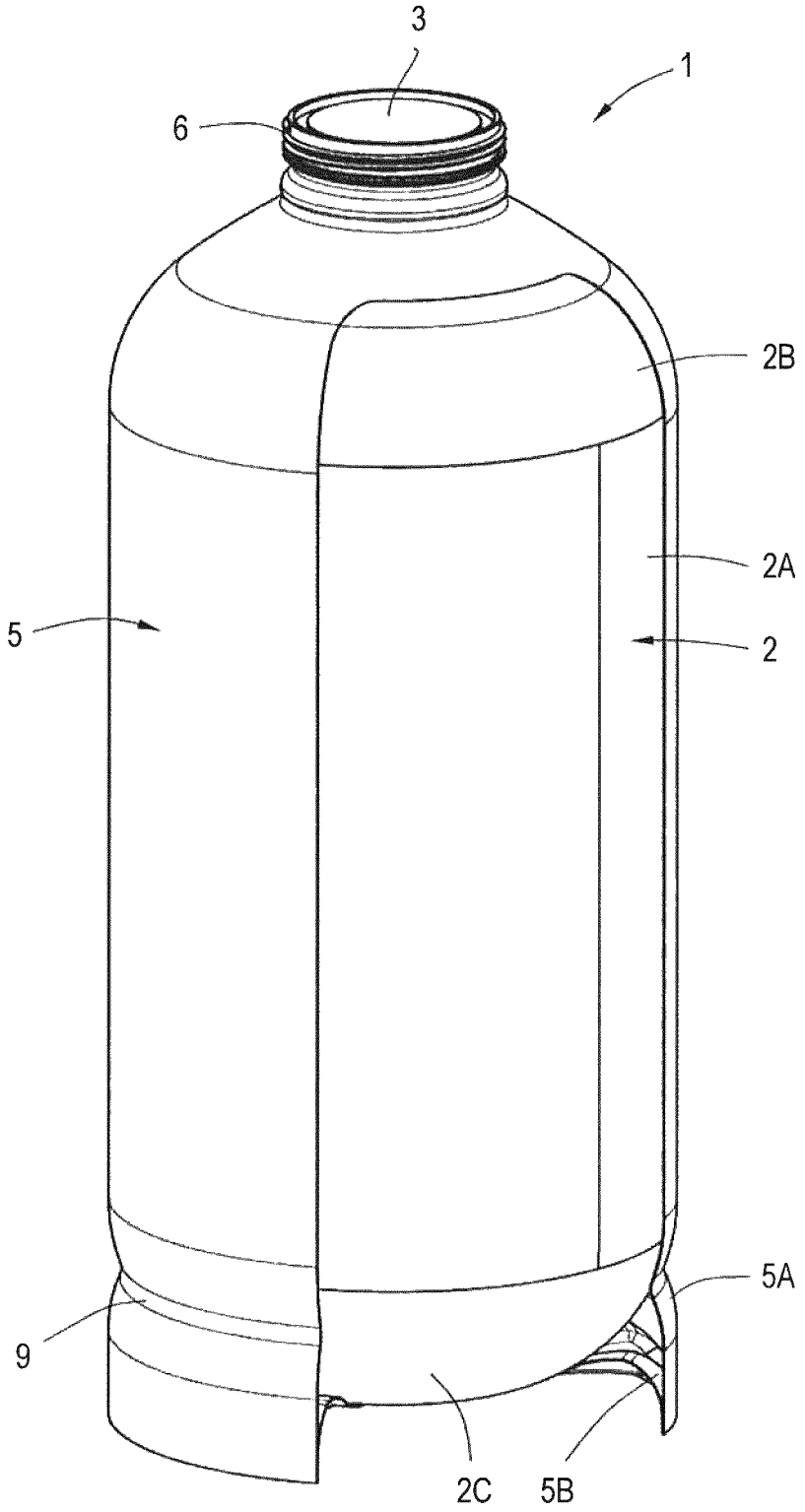
FIG. 1 is a perspective view of a container.
Figure 2A:
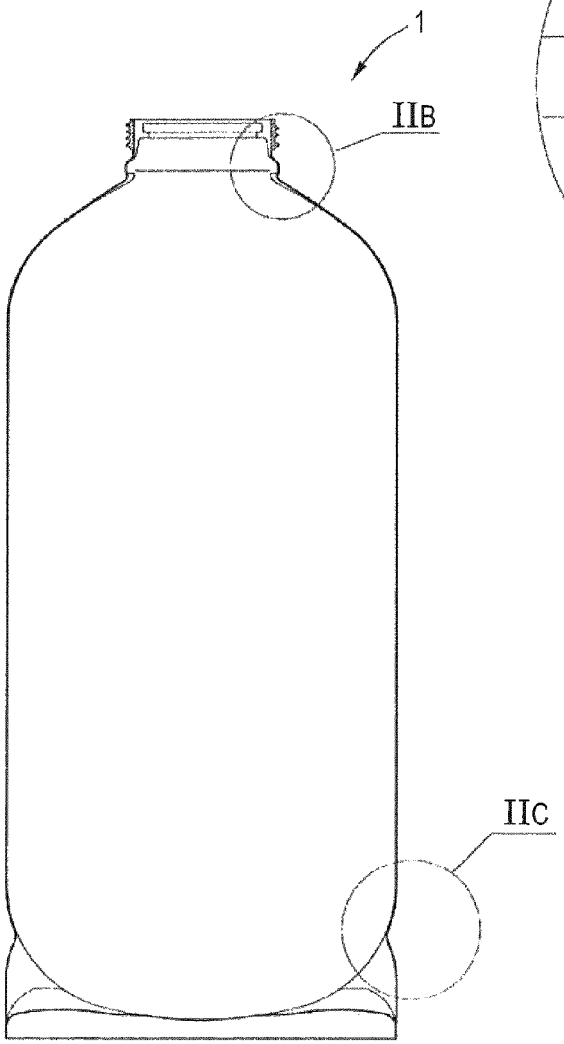
FIGS. 2A to 2C show a cross-section of a container in FIG. 1 and enlarged details of the cross-section.
Figure 2B:
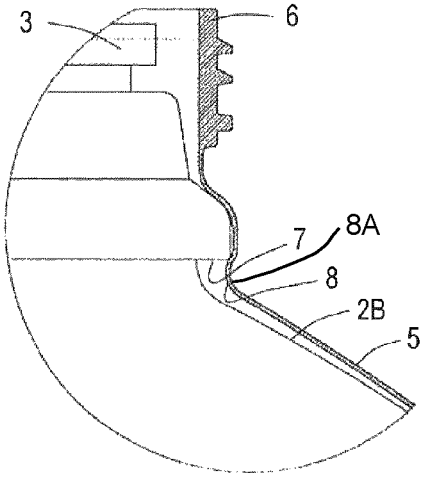
Figure 2C:
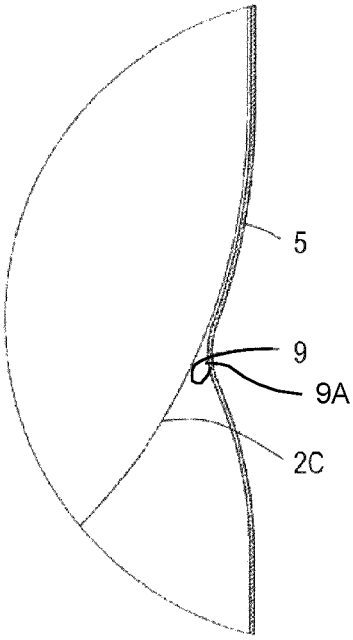

FIGS. 1 to 2C show a container 1 for a beverage containing a gas, in particular beer, comprises a casing 2 made by stretch blow molding a polyester preform, in particular PET (polyethylene terephthalate). The casing 2 comprises a substantially cylindrical middle portion 2A and top and bottom domes 2B, 2C. The top dome 2B has a central opening formed by the non-deformed part of the preform.

A valve part 3 for dispensing the beverage from the container is snap-fitted to the opening. For more details on this and other suitable valve parts reference is made to International patent application WO 00/07902 (see especially page 8, line 12 ff. in conjunction with FIGS. 4A and 4B).

In this example, a gastight bag (not shown) for receiving the beverage is connected to the valve part 3 and located inside the casing 2.

The casing 2 is enveloped by a stretch blow molded polyester shell 5. The shell was blow molded from a preform similar to that used for the casing but with a different rim, i.e. the top part of the shell further comprises a collar 6 extending around the valve part, protecting the same and providing an external thread or annular protrusion about the top opening for screwing or snapping e.g. grips onto the container.

In contrast to the casing, which preferably should have a smooth shape defined by a cylinder and two domes to withstand internal pressure and to avoid damage to the bag containing a beverage, the shell may be provided with one or more features providing additional functionality.

The shell comprises two parts 5A, 5B, separated along a circumference, i.e. in hoop direction, of the shell 5, relatively close to the bottom of the shell, such that the top part of the shell is longer than the casing. As a result, the lower rim of the upper part of the shell extends beyond the bottom of the casing and serves as the foot or part of the foot of the container. The base 5B can be discarded or be used to further increase the strength and stability of the foot. In this example, the base part is provided with creased and radially extending segments to enhance the stiffness of the base, in turn facilitating a stable upright position of the container, and to provide a crumble zone protecting the container when it falls. More specifically, the base part defines a petaloid foot and is placed, i.e. reversed and then pressed, inside the bottom end of the top part of the shell. The base part can be clamped, glued, and/or welded into the top part of the shell. The center of the base is shaped complementary to the bottom end of the casing, thus providing support over a relatively large area.

To further increase stability, it is preferred that, at the rim, the wall is corrugated to increase its effective thickness and stiffness and/or the wall is actually thicker, preferably at least two times thicker, than the wall of the cylindrical section of the shell.

In this example, the internal diameter of the collar 6 of the shell 5 is smaller than the external diameter of the valve part 3 and wall of the shell 5 comprises a circumferential protrusion 8 defined by a local constriction and also providing a smaller internal diameter. The casing can be snap fitted and positively locked by pressing the valve part 3 past the protrusion.

In an elaboration, a further circumferential protrusion 9 defined by a local constriction is applied in the lower part of the shell 5, such that it abuts or near abuts the bottom of the casing 2. In the container, it is preferred that at least one of the protrusions 8,9 is defined by a constriction of the wall of the shell, e.g. providing an annular protrusion 8,9 on the inside of the shell and an annular notch 8A,9A on the outside of the shell.

Figure 3:
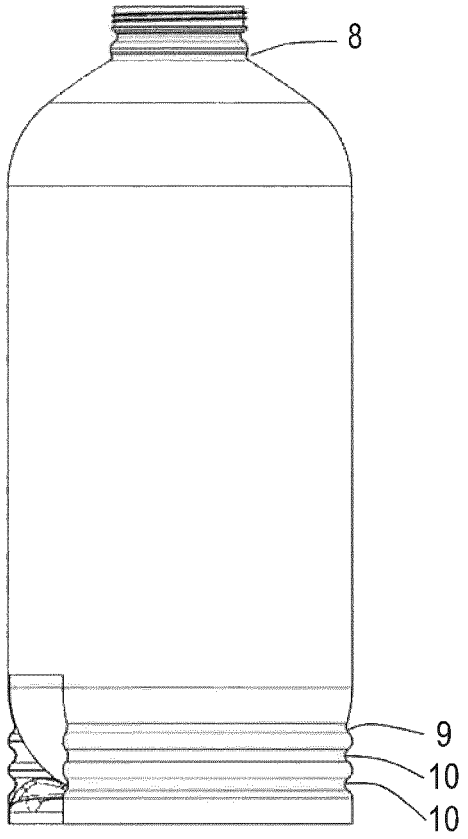
FIGS. 3 to 5 are side views of three containers, with different features for increasing buckling resistance of the lower part of the container.

FIG. 3 shows an example wherein the lower portion of the shell 5 is free from the casing and provided with further constrictions, which effectively form a bellows, thus locally increasing flexibility of the wall, also in the axial direction of the container.

Figure 4:
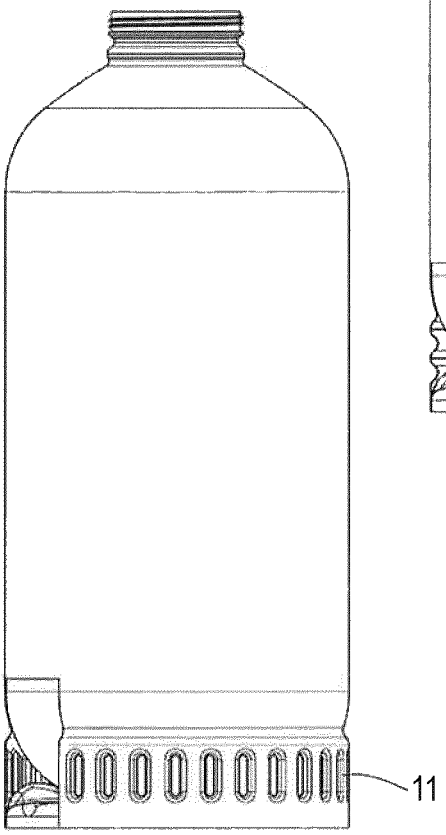
Figure 5:
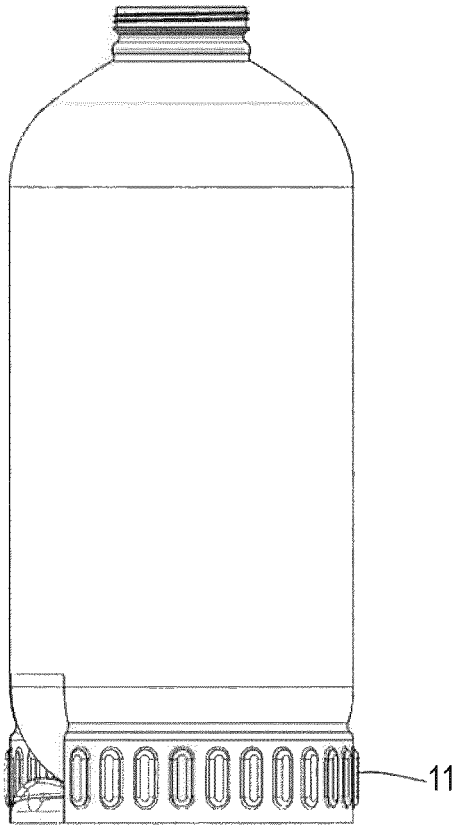

FIGS. 4 and 5 show an example wherein the lower part of the shell is embossed about its circumference with a series of indentations 11 protruding inwards (FIG. 4) or outwards (FIG. 5) so as to increases the actual or at least effective thickness in the radial direction. In general, embossing may comprise a large number of small protrusions on the outer surface of the shell, yielding e.g. a knurled surface, and/or a plurality of ribs extending in axial direction. Also, embossing may provide other, additional functions.

The invention is not restricted to the above-described embodiments which can be varied in a number of ways within the scope of the claims.

The invention claimed is:

1. A container for liquids, comprising a casing enveloped by a shell and a valve configured to dispense liquid from the container, wherein the casing has a shape-retaining contour with a cylindrical middle section, and two dome-shaped sections at opposite sides of the cylindrical middle section, including a dome-shaped bottom section and a dome-shaped upper section comprising a neck portion with the valve, and the shell has an outer wall with a first end and a second end, the outer wall having a contour defining an annular circumferential constriction of the outer wall of the shell, the annular circumferential constriction having a middle portion of shortest diameter and an adjoining adjacent portion on each side of the middle portion with a diameter greater than the shortest diameter locally constricting the outer diameter of the outer shell, the annular circumferential constriction engaging one of the dome-shaped sections at an area remote from where the dome shaped section joins the cylindrical middle section of the casing and remote from one of the first and second ends, the outer wall of the shell further having an axial length such that the outer wall extends over the cylindrical middle section and a part of the shell contour engages the other one of the dome-shaped sections so as to interlock with the contour of the casing and lock the casing in opposite axial directions along a longitudinal axis of the container between the annular circumferential constriction and the part of the shell contour engaging the other one of the dome-shaped sections.

2. The container according to claim 1, wherein the valve is part of or mounted on or in the casing, wherein the shell comprises a neck fitting over the valve, and wherein the contour defining the annular circumferential constriction is located at or in the neck fitting and locks under, over, or onto the valve.

3. The container according to claim 1, wherein the casing is snap-fitted into the shell.

4. The container according to claim 1, wherein the contour defining the annular circumferential constriction provides a circumferential watertight seal at the valve.

5. The container according to claim 1, wherein the casing has an internal volume of at least 10 liters, wherein a length to width ratio (L/D) of the casing is in excess of 1.3, wherein the container comprises a cylindrical portion that extends over at least 25% of a height of the container, and/or wherein the shell supports the casing at least when the casing is pressurized.

6. The container according to claim 1, wherein the shell comprises an upper portion and a lower portion, wherein the upper portion of the shell comprises the outer wall with the contour defining the annular circumferential constriction and wherein the lower portion of the shell comprises the outer wall with the part defining a second circumferential constriction positively locking the casing in at least an axial direction with respect to the shell.

7. The container according to claim 6, wherein the second circumferential constriction comprises a protrusion that protrudes inwardly.

8. The container according to claim 6, wherein the second circumferential constriction abuts or near abuts a bottom portion of the casing.

9. The container according to claim 6, wherein the casing and/or the shell comprises a third circumferential constriction.

10. The container according to claim 9, wherein the third circumferential constriction is located above or in a broadest part of the casing and/or the third circumferential constriction is located below or in the broadest part of the casing.

11. The container according to claim 1, wherein a lubricant is located between the casing and the shell.

12. The container according to claim 1, wherein the casing and the shell are blow molded.

13. The container according to claim 9, wherein the third circumferential constriction is defined by a circumferential protrusion of a wall of the shell.

14. The container according to claim 1, wherein the casing has an internal volume of at least 10 liters and wherein a length to width ratio (L/D) of the casing is in excess of 1.8.

15. The container according to claim 1, wherein the container comprises a cylindrical portion that extends over at least 25% of the height of the container.

16. The container according to claim 1, wherein the container comprises a cylindrical portion that extends over at least 40% of the height of the container.

17. The container according to claim 1, wherein the container comprises a cylindrical portion that extends over at least 50% of the height of the container.

18. The container according to claim 1, wherein the shell supports the casing at least when the casing is pressurized.

19. The container according to claim 1, wherein the valve is mounted to the casing.

20. The container according to claim 19, wherein the contour in the outer wall of the shell defining the annular circumferential constriction engages the valve.

21. A container for liquids, comprising:

a casing assembly comprising:

a casing; and a valve to dispense liquid from the container and being secured to a neck of the casing, wherein the casing assembly has a shape-retaining contour with a cylindrical middle section, and two outwardly facing circumferential surface portions of gradually reducing diameter at opposite ends of the casing assembly, each of the outwardly facing circumferential surface portions of gradually reducing diameter reducing in diameter in a direction away from the cylindrical middle section; and a shell having an outer wall with a contour defining an annular circumferential constriction of the outer wall of the shell locally constricting the outer diameter of the outer shell and engaging one of the outwardly facing circumferential surface portions of gradually reducing diameter at an area where the dome shaped section joins the cylindrical middle section of the casing, the outer wall of the shell further having an axial length such that the outer wall extends over the cylindrical middle section and a part of the shell contour engages the other outwardly facing circumferential surface portions of gradually reducing diameter so as to interlock with the contour of the casing assembly and lock the casing assembly in opposite axial directions along a longitudinal axis of the container between the annular circumferential constriction and the part of the shell contour engaging the other outwardly facing circumferential surface portions of gradually reducing diameter.

22. A container for liquids, comprising:

a casing assembly comprising:

a casing; and a valve to dispense liquid from the container and being secured to a neck of the casing, wherein the casing assembly has a shape-retaining contour with a cylindrical middle section, and two outwardly facing circumferential surface portions of gradually reducing diameter at opposite ends of the casing assembly, each of the outwardly facing circumferential surface portions of gradually reducing diameter reducing in diameter in a direction away from the cylindrical middle section; and a shell having an outer wall with an upper portion, middle portion and a lower portion, wherein the middle portion covers the cylindrical middle section of the casing assembly, wherein the outer wall of the upper portion of the shell has a contour defining a first annular circumferential constriction that engages one of the outwardly facing circumferential surface portions of gradually reducing diameter, and wherein the outer wall of the lower portion has a contour defining a second circumferential constriction having a middle portion of shortest diameter and an adjoining adjacent portion on each side of the middle portion with a diameter greater than the shortest diameter locally constricting the outer diameter of the outer shell, the second annular circumferential constriction engages the other of the outwardly facing circumferential surface portions of gradually reducing diameter at an area where the other of the outwardly facing circumferential surface portions of gradually reducing diameter joins the cylindrical middle section of the casing, the first and second annular circumferential constrictions inhibiting axial movement of the casing assembly in opposite directions in the shell.

* * * * *